US006557988B1

(12) United States Patent
Hartman

(10) Patent No.: US 6,557,988 B1
(45) Date of Patent: May 6, 2003

(54) RESERVE INK SUPPLY IN THERMAL INK JET CARTRIDGE INK TANKS

(75) Inventor: Pamela J. Hartman, Hilton, NY (US)

(73) Assignee: Xerox Corporation, Stamford, CT (US)

( * ) Notice: Subject to any disclaimer, the term of this patent is extended or adjusted under 35 U.S.C. 154(b) by 28 days.

(21) Appl. No.: 10/005,459

(22) Filed: Nov. 2, 2001

(51) Int. Cl.[7] ..... B41J 2/175
(52) U.S. Cl. ..... 347/85; 347/86
(58) Field of Search ..... 347/7, 9, 84, 85, 347/86, 87

(56) References Cited

U.S. PATENT DOCUMENTS 5,280,300 A * 1/1994 Fong et al. ..... 347/87
6,431,673 B1 * 8/2002 Heim et al. ..... 347/9
6,467,890 B1 * 10/2002 Tajima et al. ..... 347/87

* cited by examiner

*Primary Examiner*—Anh T. N. Vo
(74) *Attorney, Agent, or Firm*—Perman & Green, LLP

(57) ABSTRACT

A system for supplying a liquid material to an ink jet printing apparatus including a plurality of printheads is disclosed. The system includes a housing defining a first chamber and a second chamber, the second chamber including a ventilation port and being adapted to store a supply of liquid ink therein. The first chamber includes a liquid reserve pocket adapted to supply the printheads with small amounts of the liquid material therein. The second chamber includes a foam material positioned therein. The system includes a device activated by a user for piercing said reserve pocket thereby allowing any of the liquid material therein to flow into the said first chamber. The liquid material can be either ink or a maintenance fluid.

11 Claims, 3 Drawing Sheets

RESERVE INK SUPPLY IN THERMAL INK JET CARTRIDGE INK TANKS

BACKGROUND OF THE INVENTION

1. Field of the Invention

The present invention relates to ink jet recording devices such as printers, copiers, facsimile machines, word processors and plotters, and more particularly to an ink jet printing apparatus having means in the form of a reserve supply compartment for storage of extra liquid material.

2. Description of Prior Developments

The basic principle of an ink jet recording system is to eject a liquid or fused solid ink from a nozzle, slit, porous film or the like to make a recording on a medium such as paper, cloth or film. For ejecting an ink, various methods have been proposed, such as a method of ejecting an ink using electrostatic induction; namely, the so-called charge control system; a method of ejecting an ink using a piezoelectric element and an oscillation pressure; and a method of ejecting an ink using a pressure generated as a result of forming and growing bubbles by heat, the so-called thermal ink jet system. Using any of these methods, an image having a high precision on a recording material can be obtained.

Ink jet printing systems generally are of two types, i.e., continuous stream and drop-on-demand. In continuous stream ink jet systems, ink is emitted in a continuous stream under pressure through at least one orifice or nozzle. The stream is disturbed, causing it to break up into droplets at a fixed distance from the orifice. At the break-up point, the droplets are charged in accordance with digital data signals and passed through an electrostatic field which adjusts the trajectory of each droplet in order to direct it to a gutter for recirculation or to a specific location on a recording medium. In drop-on-demand systems, a droplet is expelled from an orifice directly to a position on a recording medium in accordance with information from digital data signals. A droplet is not formed or expelled unless it is to be placed on the recording medium.

Since drop-on-demand systems require no ink recovery, charging, or deflection, the system is much simpler than the continuous stream type. There are two types of drop-on-demand ink jet systems. One type of drop-on-demand system has as its major components an ink filled channel or passageway having a nozzle on one end and a piezoelectric transducer near the other end to produce pressure pulses. The relatively large size of the transducer prevents close spacing of the nozzles, and physical limitations of the transducer result in low ink drop velocity. Low drop velocity seriously diminishes tolerances for drop velocity variation and directionality, thus impacting the system's ability to produce high quality copies. Drop-on-demand systems which use piezoelectric devices to expel the droplets also suffer the disadvantage of a slow printing speed.

Another type of drop-on-demand system is known as thermal ink jet, or bubble jet, and produces high velocity droplets and allows very close spacing of nozzles. The major components of this type of drop-on-demand system are an ink filled channel having a nozzle on one end and a heat generating resistor near the nozzle. Printing signals representing digital information originate an electric current pulse in a resistive layer within each ink passageway near the orifice or nozzle, causing the ink in the immediate vicinity to evaporate almost instantaneously and create a bubble. The ink at the orifice is forced out as a propelled droplet as the bubble expands. When the hydrodynamic motion of the ink stops, the process is ready to start all over again. With the introduction of a droplet ejection system based upon thermally generated bubbles, commonly referred to as the "bubble jet" system, the drop-on-demand ink jet printers provide simpler, lower cost devices than their continuous stream counterparts, and yet have substantially the same high speed printing capability.

In all of the various ink jet printing systems described above, the ink jet printing apparatus employs a reservoir for containing the ink that is fed to a series of printheads for printing on a substrate such as paper. In view of the fact that the ink jet cassettes have reservoirs with limited capacities for ink or other fluids typically used in an ink jet apparatus, e.g. maintenance fluids such as claiming fluids there comes a time during use of an ink jet printer when for example, the ink is used up and the user is not able to complete the printing job being marked on.

SUMMARY OF THE INVENTION

In accordance with one embodiment of the features of the invention as described herein there is proposed to provide a reserve ink supply compartment positioned within an ink jet printhead ink tank. If a user runs out of ink during a printing job, the user can push a button on the ink supply tank (or turn a knob) which results in the wall of the reserve supply tank being pierced and ink contained therein being fed to the printheads to complete the printing job. Also in another embodiment of this invention, maintenance fluid for the ink jet printing apparatus (e.g. cleaning fluid) can be stored within the reserve tank and be used, for example, to clean up the printheads just prior to the installation of the next ink tank for the next printing job.

In accordance with the embodiments described herein there is defined a system for supplying a liquid material to an ink jet printing apparatus including a plurality of printheads the system comprising a housing defining a first chamber and a second chamber, the first chamber includes a ventilation port. The first chamber is adapted to store a supply of liquid ink therein, and includes a liquid reserve pocket adapted to supply the printheads with small amounts of the liquid material. The second chamber includes a foam material positioned therein.

In accordance with another embodiment of this invention there is defined a system for supplying ink to an ink jet printing apparatus including a housing for containing ink in a first chamber. The first chamber includes a reserve tank positioned therein. The reserve tank includes a supply of ink adapted to be fed to the first chamber when the first chamber runs out of ink. The housing includes a second chamber with a foam material positioned therein.

In accordance with still another embodiment of this invention there is defined a system for supplying a maintenance fluid to an ink jet printing apparatus which includes a plurality of printheads, the system comprising a housing for containing ink in a first chamber. The first chamber includes a reserve tank positioned therein. The reserve tank contains a maintenance fluid adapted to be fed from the reserve tank to the printhead.

BRIEF DESCRIPTION OF THE DRAWINGS

The accompanying drawings which are incorporated in and constitute a part of the specification illustrate specific embodiments of the invention and, together with the descriptions serve to explain the principles of the invention.

While the present invention will be described hereinafter in connection with preferred embodiments thereof, it should be understood that it is not intended to limit the invention to those embodiments. On the contrary, it is intended to cover all alternative, modifications and equivalents as may be included within the spirit and scope of the invention as defined by the appended claims.

DETAILED DESCRIPTION OF THE PREFERRED EMBODIMENT

Inks typically used in ink jet recording devices are primarily water based and comprise water, a solvent, colorants, and additives. Generally speaking, it is required that an ink used in a jet ink system possess the following characteristics.

(1) Inks should produce a uniform image having high resolution and high density. Images that are free from any blur or fog on source paper.

(2) Inks should bring about no clogging at the tip of a nozzle due to dried ink, and should always exhibit a high level of jetting responsibility and stability.

(3) Inks should provide excellent drying characteristics on paper.

(4) Inks should provide an image having good fastness.

(5) Inks should provide high long-term storage stability.

Figure 1:
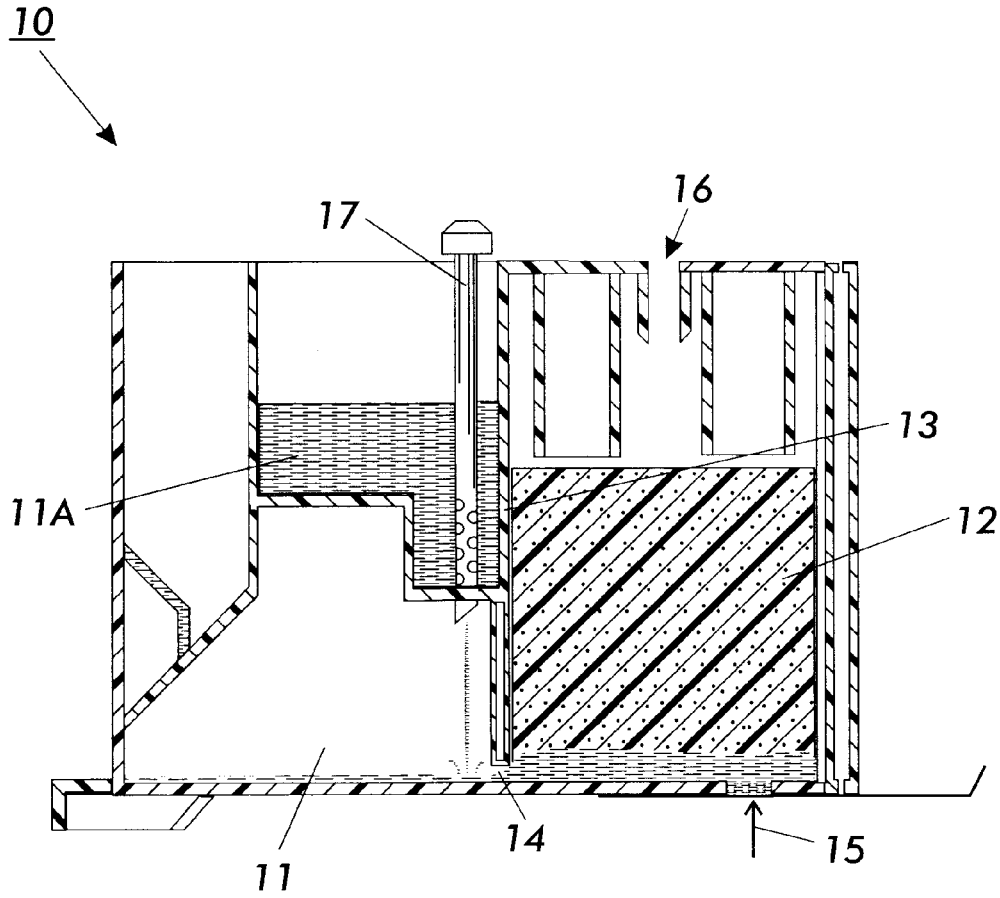
FIG. 1 is a partial plan side view of an ink jet ink storage system illustrating an embodiment of the present invention.

Inks, such as those having the characteristics defined above are used in an ink jet apparatus for printing on a substrate. Such an apparatus includes an ink cartridge which as illustrated in FIG. 1 is generally formed of a main housing 10 including an ink chamber or ink supply tank 11 for storing ink that is fed to the printheads, and a foam chamber 12 for storing a porous member such as a foam material (i.e. an ink absorbing material e.g.; a polyester fiber material) for absorbing ink. The foam material or compressed porous material is impregnated with the ink. The ink retained in the porous material is discharged to an ink ejecting portion (an ink supply port 15) by capillary action in accordance with consumption of the ink by the ejecting portion. Housing 10 is typically made of a lightweight but durable plastic material. A partition 13 separates the ink chamber 11 from the foam chamber 12 and has a hole 14 therein whereby the foam chamber 12 is in fluid communication with the ink chamber 11. The ink cartridge is also formed with an ink supply port 15 in the bottom wall of the foam chamber 13. The ink supply port can include an ink receiving and transmitting member (not shown) which extends into the tank and locally compresses the ink absorbing member. Housing 10 also has defined therein a ventilation port 16 open to the atmosphere.

Figure 2A:
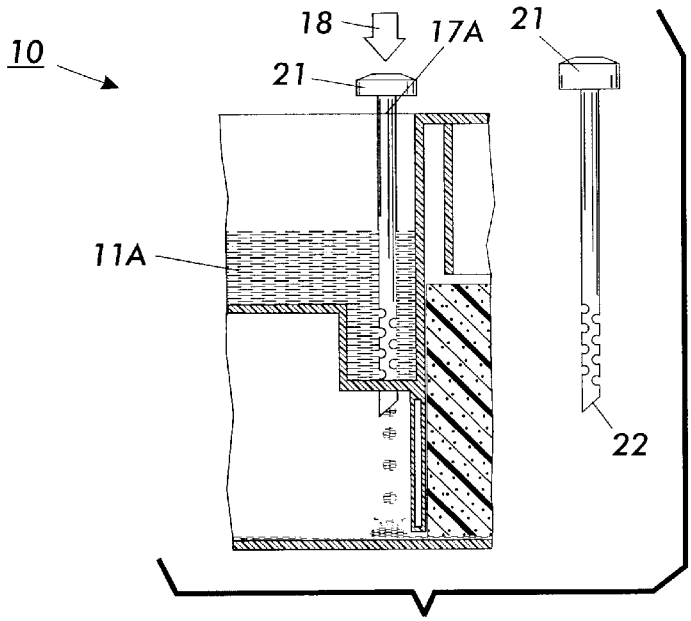
FIGS. 2A and 2B are partial plan side views of an ink jet ink storage system illustrating features of the present invention including embodiments of devices employed to pierce the wall of a reserve tank.
Figure 2B:
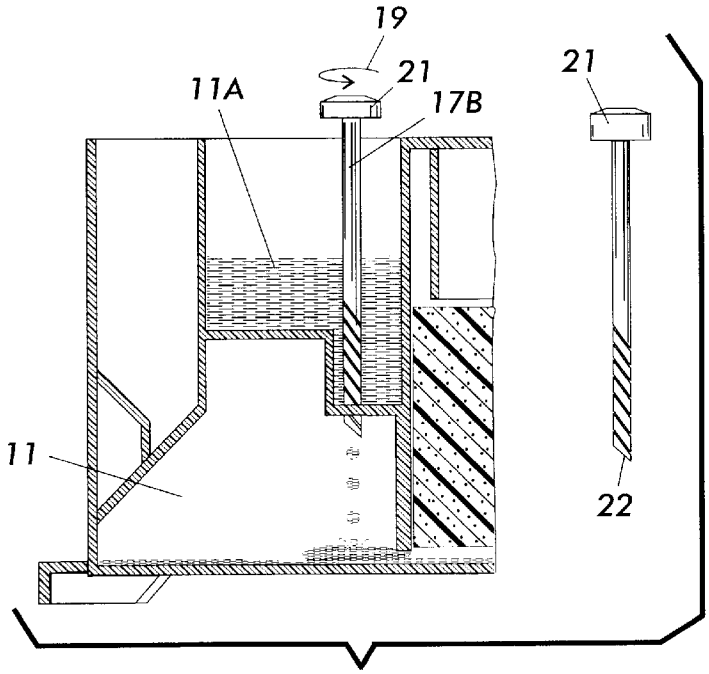

When one is printing a large job on using ink jet printer, a great detail of ink is generally used. If a new cartridge or a new ink tank with ink is not available, the issue arises as to how to complete the printing job. In accordance with one of the embodiments as described herein and as shown in FIG. 1 there is provided a small reserve pocket (tank) 11A that is included within housing 10 which contains a sufficient supply of ink that will allow a user to finish printing the last few pages of a job if a user runs out of ink, during a print job, i.e. a small reserve tank having a volume of about 1–1.5 cc of ink. The process that is followed by the user is as follows: When the user runs out of ink a device 17 in the form of, for example, a push pin (e.g. a hollow push pin) 17A or an auger (e.g. a solid auger) 17B (as illustrated in FIGS. 2A and 2B is either pushed in the direction of arrow 18 (in the case of push pin 17A) or turned in the direction of arrow 19 (in the case of auger 17B) to pierce the wall of reserve tank 11A so as to allow the ink contained in reserve tank 11A to drop into ink supply tank 11, and then into foam material 13 and then to the printhead (not shown).

The device 17 that is used to tap the wall of reserve tank 11A is a one-piece device consisting preferably of a flat plastic cover 21 and a sharp point 22 on the bottom portion thereof. To obtain use of the ink stored in reserve tank 11A, the user simply twists the knob (cover 21) in the direction of arrow 19 (in the case of the auger 17B)—(See FIG. 2B) or pushes the push pin 17A in the direction of arrow 18, i.e. pushes a hollow perforated tube, to pierce the wall of reserve tank 11A (See FIG. 2A). In both cases the end result is the same, i.e., the extra supply of ink is fed into supply tank 11 and then from tank 11 to the foam material 13 where it soaks into the foam and then onto the printheads.

Figure 3:
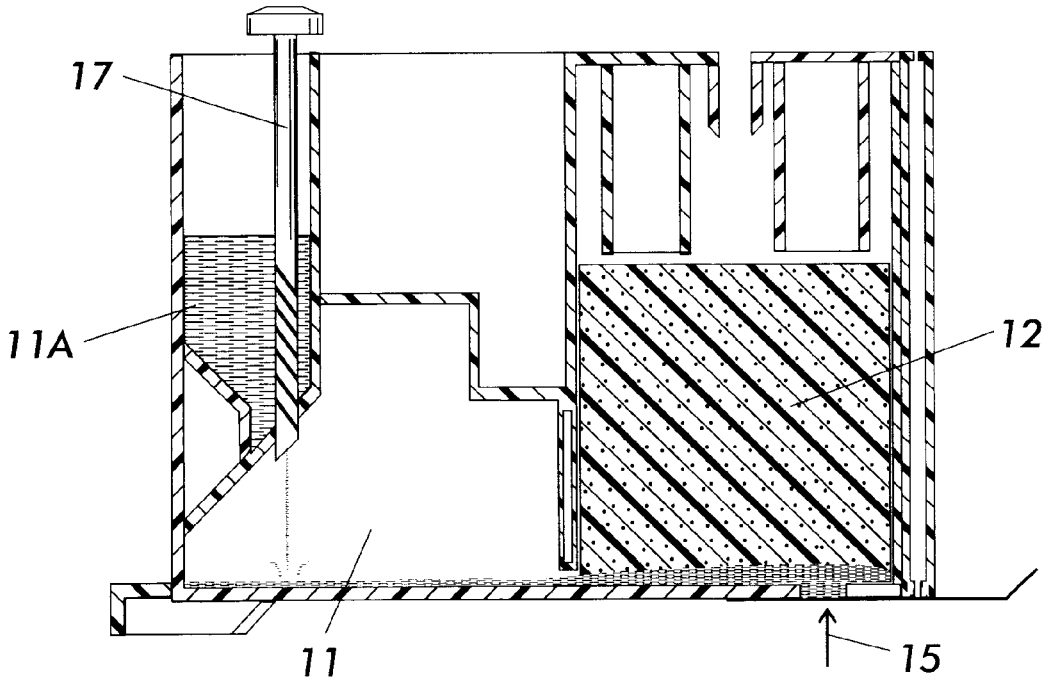
FIG. 3 is a partial plan side view of still another embodiment of an ink jet ink storage system illustrating features of the present invention.

In another embodiment of the invention as illustrated in FIG. 3 there is another location for reserve tank 11A that would be at the front portion of the main ink supply tank 11. As described above, a device 17 in the form of an auger 17B or push pin 17A would be used to pierce the reserve tank 11A to permit the extra fluid, e.g. ink to flow into the main supply tank 11 and then the foam 13 and then out the printheads. Since, positioning the extra supply tank 11A in the front of tank 11 may possibly interfere with the low ink sensor, it may not be as desirable as locating the extra reserve tank 11A in the rear port of the main tank 11.

Liquid ink printers of the type frequently referred to as continuous stream or as drop-on-demand, such as piezoelectric, acoustic, phase change wax-based or thermal, have at least one printhead from which droplets of ink are directed towards a medium, e.g. a recording sheet. Within the printhead, the ink is contained in multiple channels. Power pulses cause the droplets of ink to be expelled as required from the orifices or nozzles at the end of the channels. In a thermal ink jet marking device or printer, the power pulses are usually provided by resistors positioned in respective channels that are individually addressable to heat and vaporize ink in the channels. As voltage is applied across a selected resistor, a vapor bubble grows in the associated channel and initially bulges from the channel orifice before collapsing. The ink within the channel then retracts and separates from the bulging ink, forming a droplet moving in a direction away from the channel nozzle and toward the medium. Upon hitting the medium, the droplet forms a dot or spot of ink. The channel is then refilled by capillary action, which draws ink from an ink supply container.

The ink jet printhead may be incorporated into either a carriage type printer (i.e., a partial-width array type printer) or a page-width array type printer. The carriage type printer typically has a relatively small printhead containing the ink channels and nozzles. The printhead can be attached to a disposable ink supply cartridge. The printhead and attached ink supply carriage are reciprocated together on the carriage to print one swath of information (equal to the length of a column of the nozzles) at a time on a stationary medium. After the swath is printed, the paper is stepped forward a distance equal to the height of the printed swath or a portion thereof, so that the next printed swath is contiguous or overlapping with the previously printed swath. In contrast, the page-width array printer has a stationary printhead having a length sufficient to print across the width or length of a recording sheet. The recording medium is continually moved past the page-width array printhead in a direction substantially normal to the printhead length and at a constant or varying speed during printing.

It has been recognized that the ink ejecting nozzles of the printhead must be maintained, e.g., by periodically cleaning the orifices when the printhead is in use. In particular, a "viscous plug" of partially dried ink in the nozzle can cause the ejector to fail, at least temporarily, until the particular ejector is reheated and the viscous plug is softened and expelled. Ink droplets from a partially blocked ejector can be misdirected. The failure of even one nozzle will have conspicuous results on a print swatch, because the plugged nozzle will leave a blank stripe where ink should have been deposited. In some applications, there is also a need to prime a printhead before use to insure that the printhead channels are completely filled with ink and contain no contaminants or air bubbles.

Another important practical concern is contamination of the area around the ejectors. External debris such as lint or stray paper fibers are likely to become caught in the small gap between the front face of the printhead and the sheet, possibly entering the nozzles of the ejectors and causing a failure.

In accordance with another embodiment of the invention reserve tank 11A as described above can be filled with a maintenance fluid e.g. a cleaning fluid instead of an ink. When one would desire to, for example, clean the nozzles in the ink jet print heads (after all the ink is exhausted and before installing a new ink tank), one would allow the maintenance fluid to be fed to the printheads by first either pushing push pin 17A or turning auger 12B as described above. The bottom portion of reserve tank 16 would thereby be pierced allowing the maintenance fluid to be fed to the foam material 13 where it would be absorbed and subsequently fed to the printheads, and drawn through the nozzles by the maintenance station.

Although this invention is described in conjunction with specific embodiments thereof, many alternatives, modifications and variations will be apparent to those skilled in the art. Accordingly, the preferred embodiments of the invention as set forth above are intended to be illustrative, not limiting. Various changes to the invention may be made without departing from its true spirit and scope as defined in the following claims.

What is claimed is:

1. A system for supplying a liquid material to an ink jet printing apparatus including a plurality of printheads comprising a housing defining a first chamber and a second chamber, the second chamber including a ventilation port and being adapted to store a supply of liquid ink therein, the first chamber including a liquid reserve pocket adapted to supply the printheads with small amounts of the liquid material, the second chamber including a foam material positioned therein.

2. A system according to claim 1 wherein said liquid material is an ink and said reserve pocket includes a sufficient amount of ink to supply the apparatus with extra ink when said first chamber runs out of ink during a printing job.

3. A system according to claim 2 further including a device actuated by a user of said apparatus for piercing said reserve pocket thereby allowing said liquid material therein to flow into said first chamber.

4. A system according to claim 3 wherein said device is a push pin.

5. A system according to claim 3 wherein said device is an auger.

6. A system according to claim 1 wherein said liquid material is a maintenance fluid.

7. A system according to claim 6 wherein said maintenance fluid is a cleaning fluid.

8. A system for supplying ink to an ink jet printing apparatus comprising a housing for containing ink in a first chamber, the first chamber including a reserve tank positioned therein, the reserve tank having a supply of ink adapted to be fed to the first chamber when the first chamber runs out of ink, the housing including a second chamber for containing a foam material therein.

9. A system according to claim 8 further including a device activated by a user for piercing said reserve tank thereby allowing said ink to flow into said first chamber.

10. A system according to claim 9 wherein said device is a push pin.

11. A system according to claim 9 wherein said device is an auger.

* * * * *